US006837369B2

(12) United States Patent
Amos

(10) Patent No.: US 6,837,369 B2
(45) Date of Patent: Jan. 4, 2005

(54) SLIDE NOTCH CIGARETTE PACK SLEEVE

(75) Inventor: Gregory Y. Amos, Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 179 days.

(21) Appl. No.: 10/222,724

(22) Filed: Aug. 16, 2002

(65) Prior Publication Data

US 2004/0031704 A1 Feb. 19, 2004

(51) Int. Cl.[7] ..... B65D 85/10
(52) U.S. Cl. ..... 206/273; 229/120.1
(58) Field of Search ..... 206/142, 242, 206/256, 257, 264, 271, 273; 229/120.01

(56) References Cited

U.S. PATENT DOCUMENTS 1,870,907 A * 8/1932 Groomes et al. ..... 206/256
2,046,751 A * 7/1936 Reichel ..... 206/745
3,092,301 A 6/1963 Selle et al. ..... 229/51
2002/0121805 A1 9/2002 Chacko et al. ..... 206/256

FOREIGN PATENT DOCUMENTS

GB 453296 9/1936
JP 2002-68290 8/2002

* cited by examiner

*Primary Examiner*—Jacob K. Ackun, Jr.
(74) *Attorney, Agent, or Firm*—Connolly Bove Lodge & Hutz LLP

(57) ABSTRACT

A multi-pack packaging sleeve comprises first and second pack receiving pockets each constructed and arranged to receive at least one product pack. A sliding connection between the first and second pack receiving pockets includes a lock slot on the first pack receiving pocket and a slide lock flap on the second pack receiving pocket slidably received within the lock slot on the first pack receiving pocket. The sliding connection enables the first and second pack receiving pockets to move relative to one another between abutting positions and a position where the pack receiving pockets are slightly spaced apart from one another to thereby define a notch between the pockets for cooperative engagement with the rails of a product display and dispensing rack.

11 Claims, 3 Drawing Sheets

SLIDE NOTCH CIGARETTE PACK SLEEVE

BACKGROUND OF THE INVENTION

The present invention relates to a multi-pack packaging sleeve comprising first and second pack receiving pockets, and more particularly to a multi-pack packaging sleeve with a sliding connection between the pockets that enables the pockets to abut one another in side-by-side or back-to-back relationship or to be spaced slightly apart thereby defining a notch between the pockets for cooperation with a product display and dispensing rack.

Product packs such as cigarettes are normally sold as single units or by the carton. However, at times it is desirable for promotional purposes to market multiple product packs less then the number of packs included in a carton. For example, promotional activities may include a buy one get one free approach or buy two packs while receiving a third pack free. In order to properly implement a marketing approach of this type, desired packaging is necessary for holding two or three product packs in a single package.

One known multi-pack packaging sleeve includes a vertical hinge between adjacent pack receiving pockets. The pockets are slightly separated from another and packaging material bridges the gap between the pockets. A notch between the pockets in alignment with the hinge enables the sleeve to be used with product display and dispensing racks having front-to-back rails which receive the notches of such sleeves. The fixed space between the pack receiving pockets adds length to a 2×5 carton of such sleeves and creates difficulty in the process of applying tax stamps to the packs therein. The case packer of the tax stamping unit is basically designed to accept standard cartons, and when such longer cartons are introduced into the system it causes the unit to fail. In such instances the tax stamps must be applied by hand. Moreover, when the pockets are positioned in back-to-back engagement with one another the material in the gap between the sides of the pockets extends in an outward direction.

SUMMARY OF THE INVENTION

Accordingly, one of the objects of the present invention is multi-pack packaging sleeve for holding and displaying multiple product packs in a desirable and appealing overall package.

Another object of the present invention is a multi-pack packaging sleeve which is easy to construct and convenient to use.

Still another object of the present invention is a multi-pack packaging sleeve having a pair of pack receiving pockets with a sliding connection between the pockets that enables the pockets to abut one another when positioned in side-by-side or back-to-back relationship, but which further enables the pockets to be slightly spaced apart to thereby define a notch for cooperation with the rails of a pack display and dispensing rack.

In accordance with the present invention, a multi-pack packaging sleeve comprises a first pack receiving pocket constructed and arranged to receive at least one product pack and a second pack receiving pocket constructed and arranged to receive at least one product pack. The packaging sleeve further includes a sliding connection between the first and second pack receiving pockets comprising a lock slot on the first pack receiving pocket and a slide lock flap on the second pack receiving pocket. The slide lock flap is slidably received within the lock slot and locked thereto which enables the pockets to move relative to one another between abutting positions and a position where the pockets are slightly spaced apart.

Preferably, the first pack receiving pocket comprises front and back wall panels, right and left sidewall panels, and a connector flap having an outside surface secured to an inside surface of the right side panel. A fold line extends between the back wall panel and the connector panel, and the lock slot extends along a portion of that fold line.

Preferably, the second pack receiving pocket comprises front and back wall panels, the slide lock flap and a connector flap adjacent the left side wall panel having an outside surface secured to an inside surface of the back wall panel. The slide lock flap is adjacent to and extends outwardly from the back wall panel.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
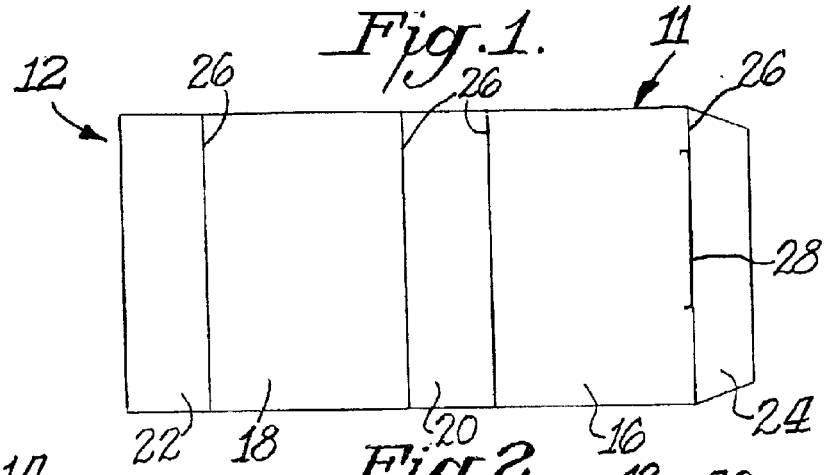
FIG. 1 is a top plan view of a first blank with fold lines and a lock slot for forming one of the pack receiving pockets of a multi-pack packaging sleeve, according to the present invention.
Figure 2:
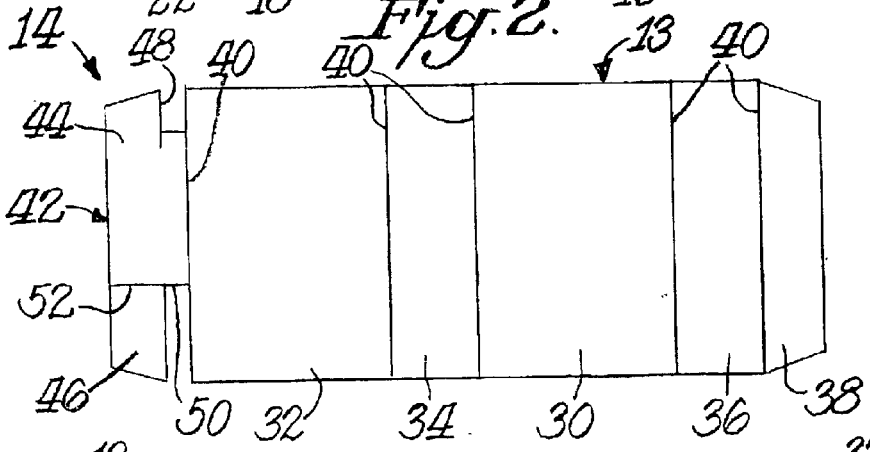
FIG. 2 is a is a top plan view of a second blank with fold lines and a slide lock flap for forming another pack receiving pocket of the multi-pack packaging sleeve, according to the present invention.
Figure 3:
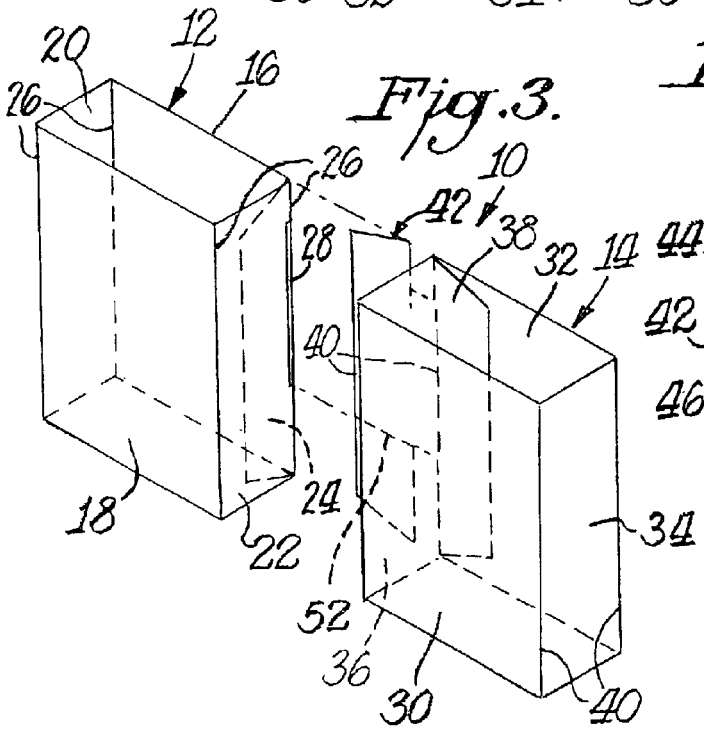
FIG. 3 is a perspective view of the assembled blanks of FIGS. 1 and 2 before the sliding connection therebetween.

Referring in more particularity to the drawings, FIGS. 1 through 3 illustrate a multi-pack packaging sleeve 10 fabricated from paperboard sheet material or any other material of this general nature. Packaging sleeve 10 comprises first and second pack receiving pockets 12, 14, each constructed and arranged to receive at least one product pack, such as a pack of cigarettes, for example. The drawings show one embodiment where each pack receiving pocket is dimensioned to receive a single product pack. Other combinations may also be utilized such as two product packs in one of the pockets and a single product pack in the other pocket, and the drawings illustrate other embodiments where the packaging sleeve includes three product packs.

FIG. 1 shows a layout for a blank 11 that forms the first pack receiving pocket 12. Specifically, pocket 12 includes a back wall panel 16 and a front wall panel 18 together with left and right side wall panels 20, 22, respectively. A connector flap 24 extends from the back wall panel 16, and fold lines 26 between the panels enable the blank to be formed into the first pack receiving pocket 12 shown in FIG. 3. Specifically, one of the fold lines 26 extends between the back wall panel 16 and the connector flap 24. Adhesive is applied to the outside of connector flap 24 which is then secured to the inside of right side wall panel 22. A lock slot 28 extends along a portion of the fold line 26 between the back wall panel and the connector flap, and the lock slot forms part of a sliding connection between the first and second pack receiving pockets 12, 14, as explained more fully below.

FIG. 2 shows a layout for a blank 13 that forms the second pack-receiving pocket 14. Specifically, pocket 14 includes a front wall panel 30 and a back wall panel 32 interconnected by a right side wall panel 34. A left side wall panel 36 extends from the front wall panel. A connector flap 38 extends from the left side wall panel, and fold lines 40 extend between the various panels and the connector flap that enable formation of the blank into the configuration of the second pack-receiving pocket 14, as shown in FIG. 3. Adhesive is applied to the outside of connector flap 38 which is then secured to the inside of the back wall panel 32. A slide lock flap 42 extends from the back wall panel 32. The slide lock flap 42 cooperates with the lock slot 28 to complete the sliding connection between the first and second pack-receiving pockets 12, 14.

As explained more fully below, the slide lock flap 42 includes a main portion 44 and a lower tab portion 46 as well as an upper undercut portion 48 and a lower undercut portion 50. These undercut portions are positioned within the lock slot 28 of the first pack receiving pocket 12 when the pockets are assembled to form the packaging sleeve 10.

Figure 4:
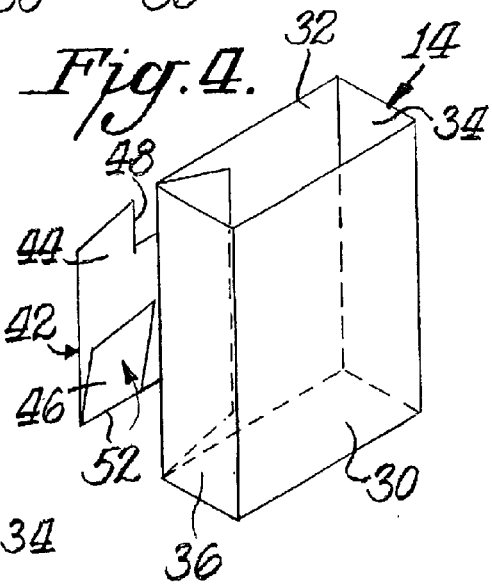
FIG. 4 is a perspective view of the assembled pack receiving pockets with the slide lock flap of one pocket folded for insertion into the lock slot of the other pocket.
Figure 5:
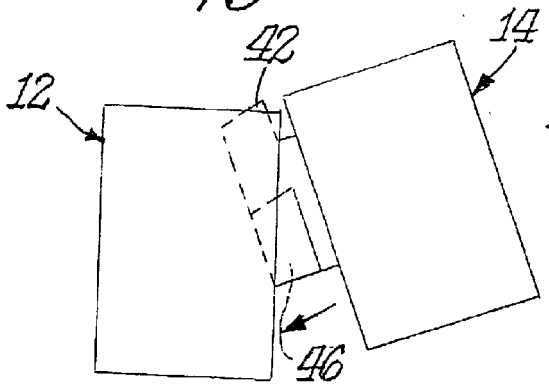
FIG. 5 is a front elevational view illustrating the initial step in assembling the pack receiving pockets together.

The sequence of assembling the first and second pack-receiving pockets 12, 14 into the multi-pack packaging sleeve 10 is best shown in FIGS. 4 through 7. Initially, as shown in FIG. 4, the lower tab portion 46 of slide lock flap 40 is folded along line 52 to a position against the main portion 44 of the slide lock flap. After such folding of the slide lock flap, the second pack receiving pocket 14 is tilted slightly and the main portion 44 of the slide lock flap is inserted into the lock slot 28 of the first pack receiving pocket 12. The upper undercut portion 48 enables upper positioning of the second pack receiving pocket 14 relative to the first pack receiving pocket 12, and this position is best shown in FIG. 5.

Figure 6:
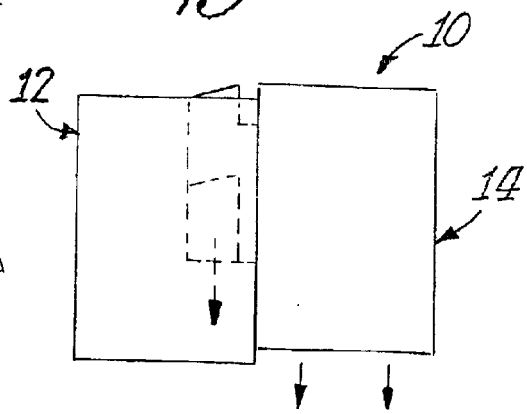
FIG. 6 is a front elevational view illustrating the next step in the sequence of assembling the pack receiving pockets together.

As shown in FIG. 6, the pack-receiving pockets are then positioned next to one another so that the right side wall panel 22 of pocket 12 engages the left side wall panel 36 of pocket 14. The lower tab portion 46 of the slide lock flap 42 is then moved to its unfolded position, and pocket 14 is dropped slightly until the lower undercut portion 50 of the slide lock flap 42 engages the lower extreme of the lock slot. This ultimate position is shown best in FIG. 7.

Figure 7:
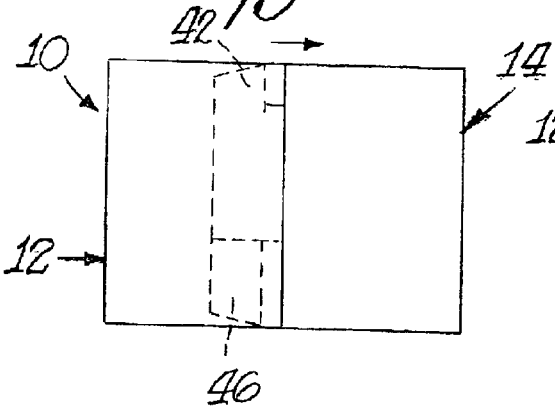
FIG. 7 is a front elevational view illustrating the final step in the sequence of assembling the pack receiving pockets together with the lock flap unfolded and locked in place.

The multi-pack packaging sleeve 10 of the present invention may be used in the position shown in FIG. 7 where the left side wall panel 36 of pocket 14 abuts the right side wall panel 22 of pocket 12.

Figure 8:
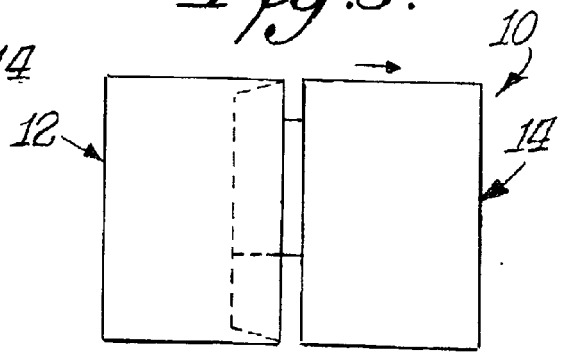
FIG. 8 is a front elevational view of the multi-pack packaging sleeve of the present invention with the pack receiving pockets spaced apart and defining a notch therebetween.

Alternatively, the pack-receiving pockets 12, 14 may be slightly spaced apart as shown in FIG. 8. Moving pocket 14 to the right as viewed in FIG. 8 causes the slide lock flap 42 to engage the inside of right side wall panel 22 of pocket 12. In this position the lower undercut portion 50 forms a notch 54 for cooperative engagement with the rails of a product display and dispensing rack, as explained more fully below.

Figure 8A:
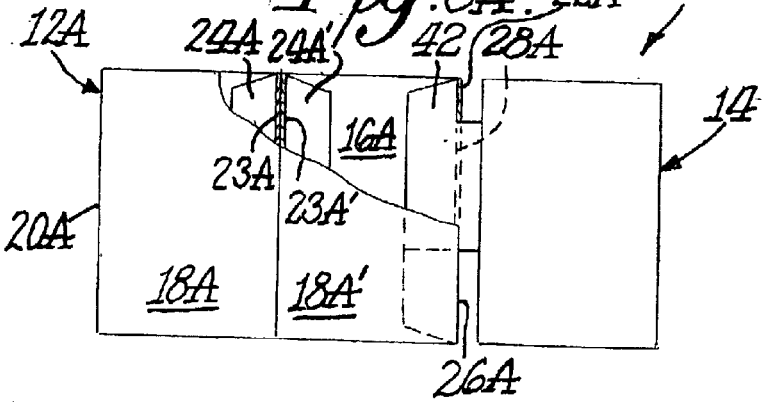
FIG. 8A is a front elevational view of an alternate embodiment of the multi-pack packaging sleeve of the present invention.

FIG. 8A illustrates an alternate embodiment of the present invention in the form of a multi-pack packaging sleeve 10A fabricated of paperboard sheet material or any other material of this general nature. Packaging sleeve 10A comprising first and second pack receiving pockets 12A, 14 constructed and arranged to receive product packs, such as cigarettes, for example. Pack receiving pocket 14 of packaging sleeve 10A is the same as pocket 14 described above, and similar references characters are used to identify similar parts. On the other hand, pack receiving pocket 12A is different from pocket 12 in that pocket 12A is constructed and arranged to receive a pair of product packs. Packaging sleeve 10A may be used in promotions where purchasers buy two packs and receive a third pack free of charge.

Pack receiving pocket 12A includes a long back wall panel 16A and a pair of front wall panels 18A and 18A' together with left and right side wall panels 20A, 22A, respectively. Pocket divider flaps 23A and 23A' extend from the front wall panels 18A, 18A', and connector flaps 24A, 24A' extend from the pocket divider flaps 23A, 23A', as shown in FIG. 8A. Adhesive may be applied to the outside of connector flaps 24A, 24A' which are then secured to the inside of the back wall panel 16A midway along its length. A lock slot 28A extends along a portion of the fold line 26A between the back wall panel 16A and the right side wall panel 22A. The lock slot 28A forms part of the sliding connection between the first and second pack receiving pockets 12A, 14.

The sliding connection between the first and second pack receiving pockets 12A, 14 comprises the slide lock flap 42 on pocket 14 and the lock slot 28A on pocket 12A. Otherwise the sliding connection of packaging sleeve 10A functions in the same manner as in packaging sleeve 10.

Figure 8B:
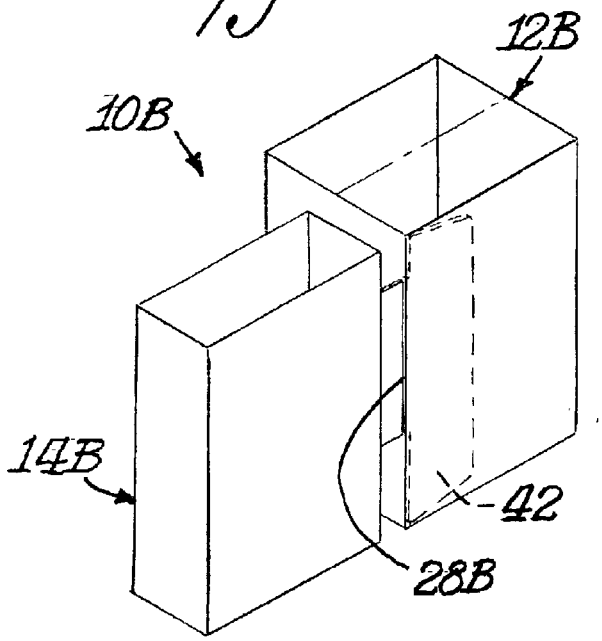
FIG. 8B is a perspective view of another alternate embodiment of the multi-pack packaging sleeve of the present invention.

FIG. 8B illustrates still another embodiment of the present invention in the form of a multi-pack packaging sleeve 10B fabricated of paperboard sheet material or any other material of this general nature. Packaging sleeve 10B comprising first and second pack receiving pockets 12B, 14 constructed and arranged to receive product packs, such as cigarettes, for example. Pack receiving pocket 14 of packaging sleeve 10B is the same as pocket 14 described above, and similar references characters are used to identify similar parts. On the other hand, pack receiving pocket 12B is different from pocket 12 in that pocket 12B is constructed and arranged to receive a pair of product packs. Packaging sleeve 10B may be used in promotions where purchasers buy two packs and receive a third pack free of charge.

The sliding connection between the first and second pack receiving pockets 12B, 14 comprises a slide lock flap 42 on pocket 14 and a lock slot 28B on pocket 12B. Otherwise the sliding connection of packaging sleeve 10B functions in the same manner as in packaging sleeve 10.

Figure 9:
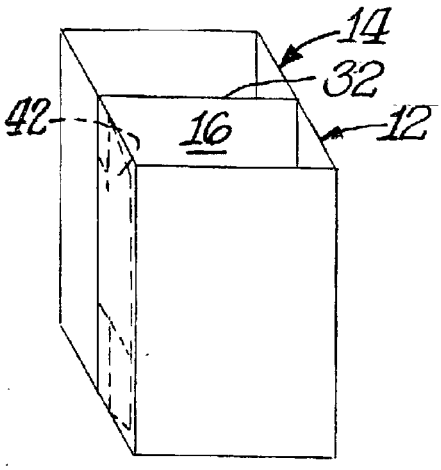
FIG. 9 is a perspective view of the multi-pack packaging sleeve of the present invention with the pack receiving pockets abutting one another in back-to-back relationship.

The first and second pack receiving pockets 12, 14 may also be positioned in abutting relationship with one another with the back wall panel 16 of the first pocket 12 engaging the back wall panel 32 of the second pocket 14. This position of the multi-pack packaging sleeve 10 is shown best in FIG. 9. Such position is achieved by articulating the first pocket 12 along the fold line 26 between the back wall panel 16 and the connector flap 24, and articulating the second pocket 14 along the fold line 40 between the back wall panel 32 and the slide lock flap 42. Packaging sleeves 10A and 10B may be similarly positioned.

Figure 10:
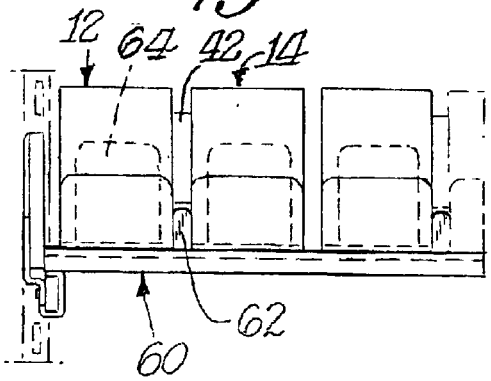
FIG. 10 is a fragmental front elevational view of the multi-pack packaging sleeves of the present invention in the configuration of FIG. 8 positioned in a product display and dispensing rack.

FIG. 10 shows a product display rack 60 for holding a plurality of multi-pack packaging sleeves 10, 10A, 10B of the present invention. The display and dispensing rack 60 includes front to back rails 62 which receive the notches 54 when the sleeves are configured with the pockets thereof slightly spaced apart. Spring loaded pushers 64 maintain the sleeves at forward positions on the display and dispensing rack.

The multi-pack packaging 10 of the present invention is flexible to the extent that it has several positions including the one where the pockets are slightly spaced apart for assembly upon the rails 62 of the product display and dispensing rack 60 shown in FIG. 10. Additionally, the pockets may abut one another in side-to-side relationship, such as shown in FIG. 7, which aids in the tax stamping process when the sleeves are positioned within a 2×5 product pack carton. When the notch is needed, the pockets are simply pulled apart to thereby create the notch otherwise the notch is contained within the interior of the first pack receiving pocket 12 which reduces the overall carton length thereby allowing the cartons to efficiently enter and exit the tax stamp process. Additionally, the pockets may be positioned in an abutting relationship side-to-side or back-to-back.

Most tax stamp applicators are designed to apply 10 stamps at a time, one for each pack in the carton. With no adjustment of most stamp applicator units, a carton that is too long may cause the case packer to fail since the packer is designed to accept standard carton lengths. Under these circumstances the wholesaler may be forced to apply the stamps by hand.

Although several embodiments of the packaging sleeve have been shown and described, the invention is not limited to the described embodiments and may encompass other arrangements within the scope of the attached claims. The embodiments shown and described have been presented for purposes of illustration and not of limitation.

What is claimed is:

1. A multi-pack packaging sleeve comprising:

a first pack receiving pocket constructed and arranged to receive at least one product pack;

a second pack receiving pocket constructed and arranged to receive at least one product pack; and a sliding connection between the first and second pack receiving pockets;

the sliding connection including:

a lock slot on the first pack receiving pocket; and a slide lock flap on the second pack receiving pocket slidably received within the lock slot of the first pack receiving pocket and locked thereto whereby the first and second pack receiving pockets are movable relative to one another between abutting positions and a position where the pockets are slightly spaced apart.

2. A multi-pack packaging sleeve as in claim 1 wherein each of the first and second pack receiving pockets is constructed and arranged to receive one product pack.

3. A multi-pack packaging sleeve as in claim 1 wherein the first pack receiving pocket comprises:

front and back wall panels;

right and left sidewall panels; and a connector flap adjacent the back wall panel having an outside surface secured to an inside surface of the right side panel.

4. A multi-pack packaging sleeve as in claim 3 wherein the first pack receiving pocket includes a fold line between the back wall panel and the connector flap, and wherein the lock slot extends along a portion of the fold line.

5. A multi-pack packaging sleeve as in claim 1 wherein the second pack receiving pocket comprises:

front and back wall panels;

right and left sidewall panels;

a connector flap adjacent the right side wall panel having an outside surface secured to an inside surface of the back wall panel; and the slide lock flap.

6. A multi-pack packaging sleeve as in claim 5 wherein the slide lock flap is adjacent to and extends outwardly form the back wall panel.

7. A multi-pack packaging sleeves in claim 1 wherein the slide lock flap includes upper and lower undercut portions within the lock slot of the first pack receiving pocket.

8. A multi-pack packaging sleeve as in claim 7 wherein the lower undercut portion of the slide lock flap defines a notch when the pockets are slightly spaced apart.

9. A multi-pack packaging sleeve as in claim 1 wherein at least one of the pack receiving pockets is constructed and arranged to receive two product packs.

10. A blank for a pack receiving pocket of a multi-pack packaging sleeve, the blank including:

front and back wall panels;

right and left side wall panels;

a connector flap adjacent the back wall panel having an outside surface for securement to an inside surface of the right side panel;

a fold line between the back wall panel and the connector flap; and a lock slot extending along a portion of the fold line constructed and arranged for cooperative engagement with a slide lock flap on another pack receiving pocket.

11. A blank for a pack receiving pocket of a multi-pack packaging sleeve, the blank including:

front and back wall panels;

right and left side wall panels;

a connector flap adjacent the right side wall panel having an outside surface for securement to an inside surface of the back wall panel; and a side lock flap extending from the panel for cooperative engagement with a lock slot on another pack receiving pocket.

* * * * *